US005394843A

United States Patent [19]

Decuir

[11] Patent Number: 5,394,843

[45] Date of Patent: Mar. 7, 1995

[54] VALVE CONTROL DEVICE

[75] Inventor: Alex J. Decuir, Moreno Valley, Calif.

[73] Assignee: Decuir Development Company, Riverside, Calif.

[21] Appl. No.: 101,472

[22] Filed: Aug. 2, 1993

Related U.S. Application Data

[63] Continuation-in-part of Ser. No. 69,079, May 28, 1993, Pat. No. 5,347,965.

[51] Int. Cl.[6] ..... F01L 1/14; F01L 1/18

[52] U.S. Cl. ..... 123/90.39; 123/90.61; 123/90.64

[58] Field of Search ..... 123/90.39, 90.45, 90.61, 123/90.65, 90.64, 90.67

[56] References Cited

U.S. PATENT DOCUMENTS

| | | | |
|---|---|---|---|
| 992,089 | 5/1911 | Watt | 123/41 R |
| 993,875 | 5/1911 | Richards et al. | 123/188.2 |
| 1,080,733 | 12/1913 | Thomson | 123/346 |
| 1,220,380 | 3/1917 | Turner | 123/90.39 |
| 1,246,343 | 11/1917 | Snadecki | 123/90.52 |
| 1,252,692 | 1/1918 | Harris | 123/79 R |
| 1,605,494 | 11/1926 | Anderson | 123/90.61 |
| 2,067,114 | 1/1937 | Ashton | 123/90.61 |
| 2,071,719 | 2/1937 | Wurtele | 123/90.61 |
| 2,735,313 | 2/1956 | Dickson | 123/90.61 |
| 2,743,712 | 5/1956 | Hulsing | 123/90.61 |
| 2,927,566 | 3/1960 | Moye | 123/90.61 |
| 3,021,826 | 2/1962 | De Fuzzy et al. | 123/90.65 |
| 3,024,775 | 3/1962 | Wuest | 123/90.61 |
| 3,101,402 | 8/1963 | Gondek | 123/90.61 |
| 3,273,546 | 9/1966 | Arx | 123/90.61 |
| 3,518,976 | 7/1970 | Thuesen | 123/90.16 |
| 4,589,384 | 5/1986 | Ott | 123/90.61 |
| 4,694,788 | 9/1987 | Craig | 123/90.16 |
| 5,027,763 | 7/1991 | Mallas | 123/90.61 |
| 5,069,173 | 12/1991 | Mallas | 123/90.61 |

FOREIGN PATENT DOCUMENTS

| | | | |
|---|---|---|---|
| 1290755 | 3/1962 | France | 123/90.61 |

*Primary Examiner*—E. Rollins Cross
*Assistant Examiner*—Weilun Lo
*Attorney, Agent, or Firm*—Pretty, Schroeder, Brueggemann & Clark

[57] ABSTRACT

A valve control device and related method of valve control which enhances performance characteristics of an internal combustion engine that utilizes push rods and extends the useful life of the valve control device is provided. The valve control device includes a valve engagement assembly which, in response to movement of the camshaft associated with the engine, interacts with a first valve closure mechanism associated with the valve such that the valve is efficiently opened and closed. The valve engagement assembly includes a rocker arm, which is pivotally connected to the engine and associated with a push rod which is reciprocable in response to movement of the camshaft. Further, a second valve closure mechanism is associated with the push rod for actuating downward movement of the push rod in cooperation, and substantially in unison, with the first valve closure mechanism which is engageable with the rocker arm. Each valve closure mechanism can be a compression spring of predetermined stiffness or elasticity and relative strength. The push rod can be connected to the rocker arm through a ball and socket joint that allows the push rod to rotate and spin during the upward and downward movement of the push rod.

10 Claims, 12 Drawing Sheets

FIG. 5
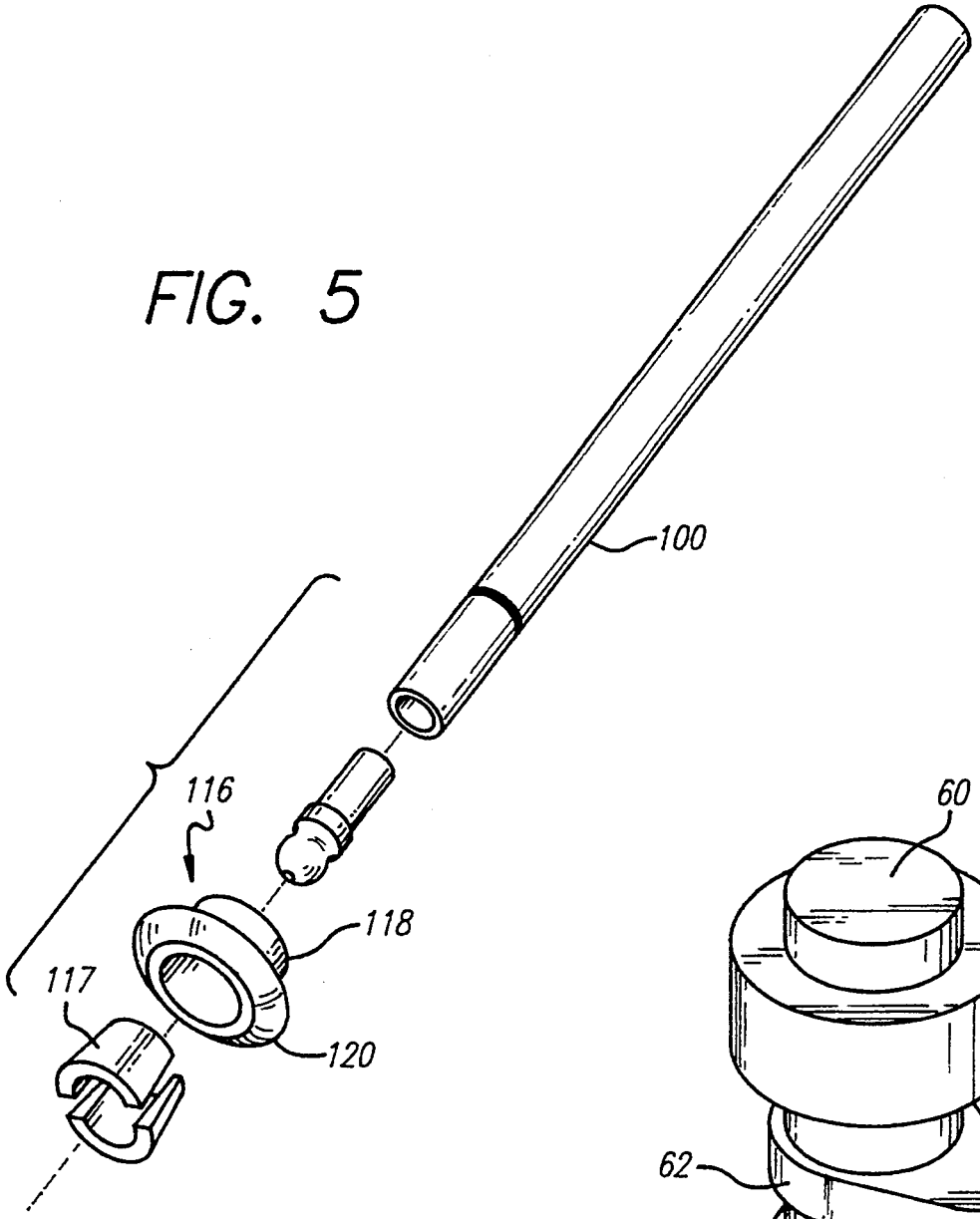
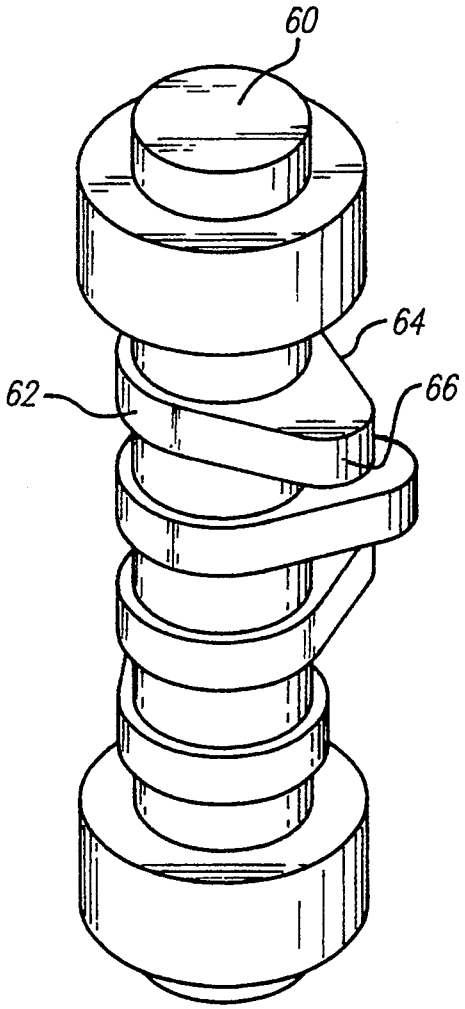
FIG. 6

VALVE CONTROL DEVICE

This is a continuation-in-part of U.S. application Ser. No. 08/069,079, filed May 28, 1993, now U.S. Pat. No. 5,347,965.

BACKGROUND OF THE INVENTION

This invention relates generally to valve control devices for engines and, more particularly, to valve control devices and related methods of valve control for valves associated with internal combustion engines that utilize push rods. Proper control of engine valves is well recognized as an essential means of maximizing performance characteristics of many internal combustion engines. Therefore, a considerable amount of effort has been expended in the development of valve control devices which efficiently and effectively regulate the valves of internal combustion engines.

A variety of valve control devices for internal combustion engines are known. Typically, they include a rocker arm which is engageable with a push rod and a valve stem which is associated with one or more valve springs. Movement of the camshaft of the engine actuates the push rod, thereby pivoting the rocker arm against the stem of the valve and the biasing force of the spring or springs so as to temporarily open the valve.

FIG. 9 depicts a representative example of a conventional valve control device for an automobile engine which engine includes a cylinder head 10 having a valve 12 whose stem 14 extends through the cylinder head and through the valve guide 15 and is capped by a retainer 16. A rotatable camshaft 18 having a cam lobe 20 with a neutral circular surface 22 and an arcuate lifting apex 24 also extends axially beneath the cylinder head. The valve control device includes a pair of valve springs 26 and 27 and a rocker arm 28 which is pivotally connected to the cylinder head through shaft 30 and associated with a reciprocable push rod 32 that extends longitudinally through a thoroughbore 34 in the cylinder head 10. The valve springs 26 and 27 are compression springs which are situated around the protruding portion of the stem 14 and against the retainer 16, thereby holding the valve 12 projected in its normal closed position and appropriately maintaining the seat pressure exerted on the valve 12. (See, FIG. 9). Valve spring 26 is also stronger than valve spring 27.

The rocker arm 28 includes a contact roller 36 which is rotatably mounted on a roller shaft 38 situated at the end of the rocker arm that is adjacent to the stem 14. The top end of the push rod 32 is received within a concavity defined in the rocker arm 28. When the push rod is aligned with the neutral circular surface 22 of the cam lobe 20, the contact roller of the rocker arm is typically almost in contact with the stem 14.

As the cam lobe 20 rotates, its arcuate apex 24 moves the push rod 32 longitudinally upward such that the contact roller 36 of the rocker arm 28 impacts the stem 14 as the rocker arm pivots. Consequently, the contact roller 36 pushes the stem 14 of the valve 12 against the combined biasing force of the valve springs 26 and 27 and the valve is opened. As the cam lobe continues to rotate, the push rod moves in relation to the arcuate apex such that the now compressed valve springs expand and force the push rod longitudinally downward by thrusting the side of the rocker arm adjacent to stem 14 upward or clockwise (See, FIG. 9). The push rod thus returns to its neutral position.

Other variations of valve control devices also exist, including devices that have a valve lifter 37 situated at the bottom of the push rod for transmitting the action of the camshaft to the push rod. (See, FIG. 9).

While devices of this nature have performed reasonably well in terms of valve regulation, they have a number of drawbacks. For instance, the rocker arm that is a component of such devices tends to be damaged too frequently due to the stress induced on it by repeated rapid engagement with the valve stem. The end of the valve stem may also tend to wear or fail too quickly due to the biasing force of the valve springs acting directly on the valve. Moreover, to the extent that energy from the engine is utilized to actuate such devices upon their interaction with the camshaft, less energy from the engine is available for moving or otherwise operating the motor vehicle. This utilization of energy tends to have a negative effect on performance characteristics of the engine, on overall fuel economy, and on the engine's output of pollutants into the atmosphere as well as on engine and oil operating temperature and overall wear and tear on the engine. These disadvantages have prompted the automobile industry to employ overhead cam assemblies.

It should, therefore, be appreciated that there exists a definite need for a valve control device, and related method of valve control, which is capable of enhancing certain performance characteristics of an internal combustion engine utilizing push rods and the useful life of valve control devices, and which tends to improve fuel economy and lessen the engine's output of certain pollutants, and which further tends to reduce oil and engine operating temperature and wear and tear on the engine.

SUMMARY OF THE INVENTION

The present invention, which addresses this need, is embodied in a valve control device, and related method of valve control, which enhances performance characteristics of an internal combustion engine utilizing push rods by reducing the amount of the engine's energy that would otherwise be necessary to regulate the valves of the engine and which extends the useful life of the device by reducing stress exerted on the rocker arm and on the push rod associated with the device. As such, the engine has an increased amount of available torque and horsepower and tends to run more smoothly, and to accelerate more quickly. Moreover, the device tends to result in improved fuel consumption, lower oil and engine operating temperature diminished output of pollutants, and increased engine life.

More particularly, the valve control device of the present invention includes a valve engagement assembly which, in response to movement of a camshaft associated with an engine, interacts with a first valve closure mechanism associated with the valve such that the valve is repeatedly, efficiently, opened and closed. The valve engagement assembly includes a rocker arm which is pivotally connected to the engine and associated with a push rod which is reciprocable in response to movement of the camshaft. The rocker arm is engageable with the first valve closure mechanism. The push rod has a second valve closure mechanism associated with it for actuating downward movement of the push rod in cooperation with the first valve closure mechanism once the valve is in an open position, thereby returning the push rod to its original or neutral position and closing the valve. The rocker arm likewise returns to its neutral position.

The first and second valve closure mechanisms are advantageously, but not necessarily, valve and push rod springs of the compression type which are of predetermined stiffness or elasticity with the push rod spring being weaker than the valve spring. Alternatively, the push rod spring can be of equal or greater strength than the valve spring. The rocker arm also advantageously has reduced stress exerted on it due to the utilization of a preselected combination of valve and push rod springs.

In more detailed aspects of the invention, the valve engagement assembly further includes an annular stop secured to the push rod and a seating plate secured to the cylinder head. The seating plate defines a bore for receiving the push rod and an indentation for receiving the push rod spring. Thus, the push rod spring is situated between the stop and the seating plate with one end of the push rod spring being secured against the stop and the other end of the push rod spring being anchorable within the indentation. In still further detailed aspects of the invention, a third valve closure mechanism, such as a suitable spring connected to the rocker arm and to the valve, can be utilized.

In another more detailed feature of the invention, the push rod is connected to the rocker arm by means of a ball and socket joint. The push rod has a spherical ball at one end. The rocker arm has a threaded hole into which is screwed the threaded end of an adjustment rod. At the other end of the adjustment rod is a socket of predetermined internal configuration for capturing the ball such that the push rod may rotate and spin within the ball and socket joint.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

In the accompanying, illustrative drawings:

FIG. 5 is an exploded perspective view of components of the push rod assembly of FIG. 1.

FIG. 6 is an enlarged perspective view of the camshaft shown in FIG. 1 with associated cam lobes.

DESCRIPTION OF THE PREFERRED EMBODIMENTS

Figure 1:
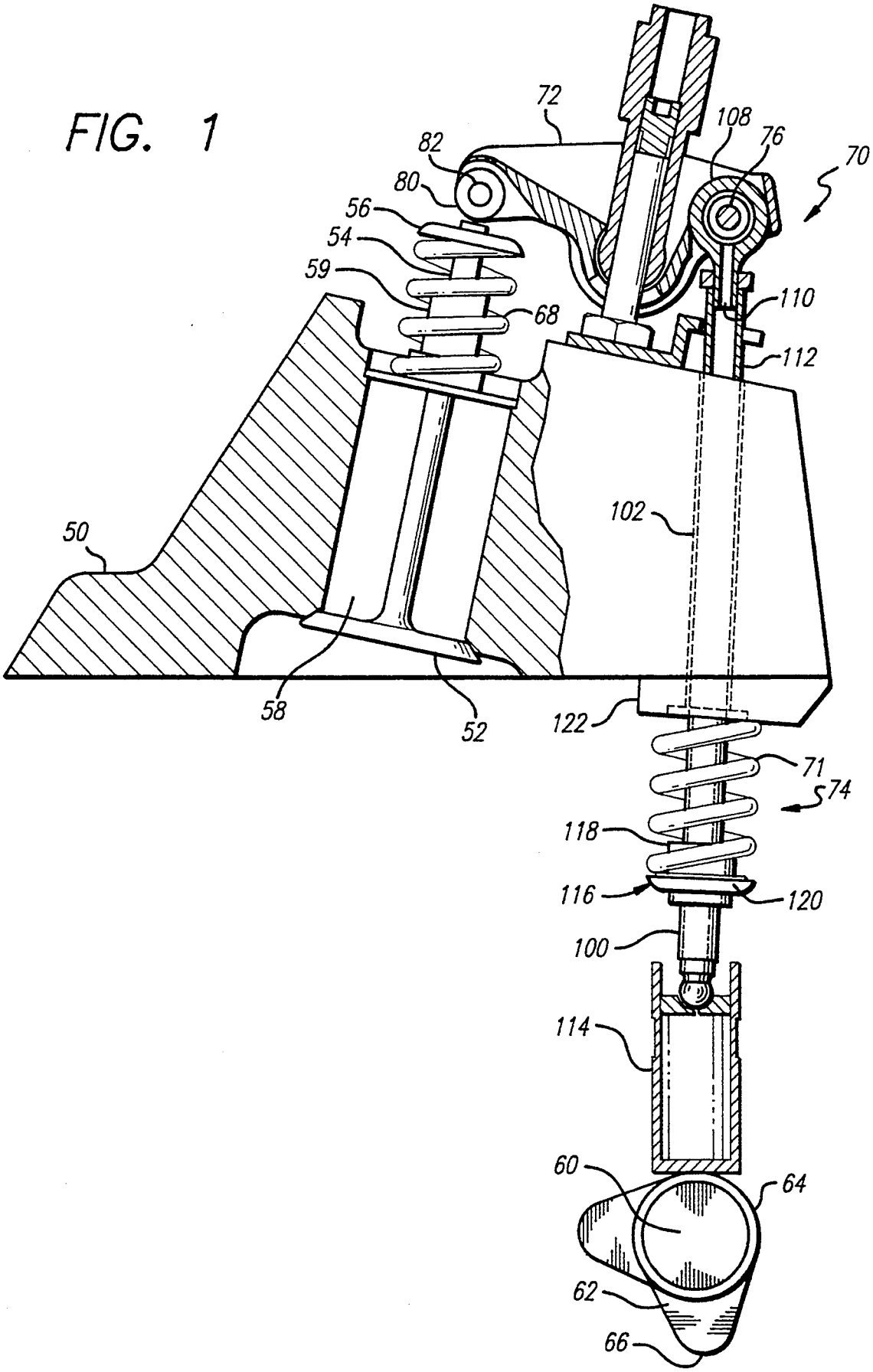
FIG. 1 is a side elevational and partially sectional view of the valve control device of the present invention shown associated with a cylinder head of an engine and its associated camshaft.

With reference now to the exemplary drawings, and particularly to FIG. 1, there is shown a cylinder head 50 of an engine which engine includes a valve 52 depicted in a closed position and having a stem 54 capped by a retainer 56. The stem extends through a cavity 58 in the cylinder head and protrudes outwardly from the cylinder head through a valve guide 59. A camshaft 60 mounted on suitable bearings extends beneath the cylinder head 50 and, as is conventional, includes a series of cam wheels or cam lobes 62 which are rotatable with the camshaft (See, FIGS. 1 and 6). Each cam lobe has a neutral substantially circular surface 64 and an arcuate lifting apex 66 which protrudes radially from its otherwise neutral surface.

In accordance with one embodiment of the invention, a valve control device for regulating movement of the valve in response to movement of the camshaft 60 is shown in FIG. 1. The device includes a valve spring 68 which is situated around the portion of the stem 54 of the valve 52 that protrudes from the cylinder head 50, and a valve engagement assembly 70 which interacts with the valve spring upon actuation by the cam lobe 62 of the camshaft. It will be observed (See, FIG. 1) that the valve spring 68 and valve engagement assembly 70 are in a neutral position when the valve is closed and assume an engagement position as the arcuate apex 66 of the cam lobe begins to actuate the valve engagement assembly.

Figure 9:
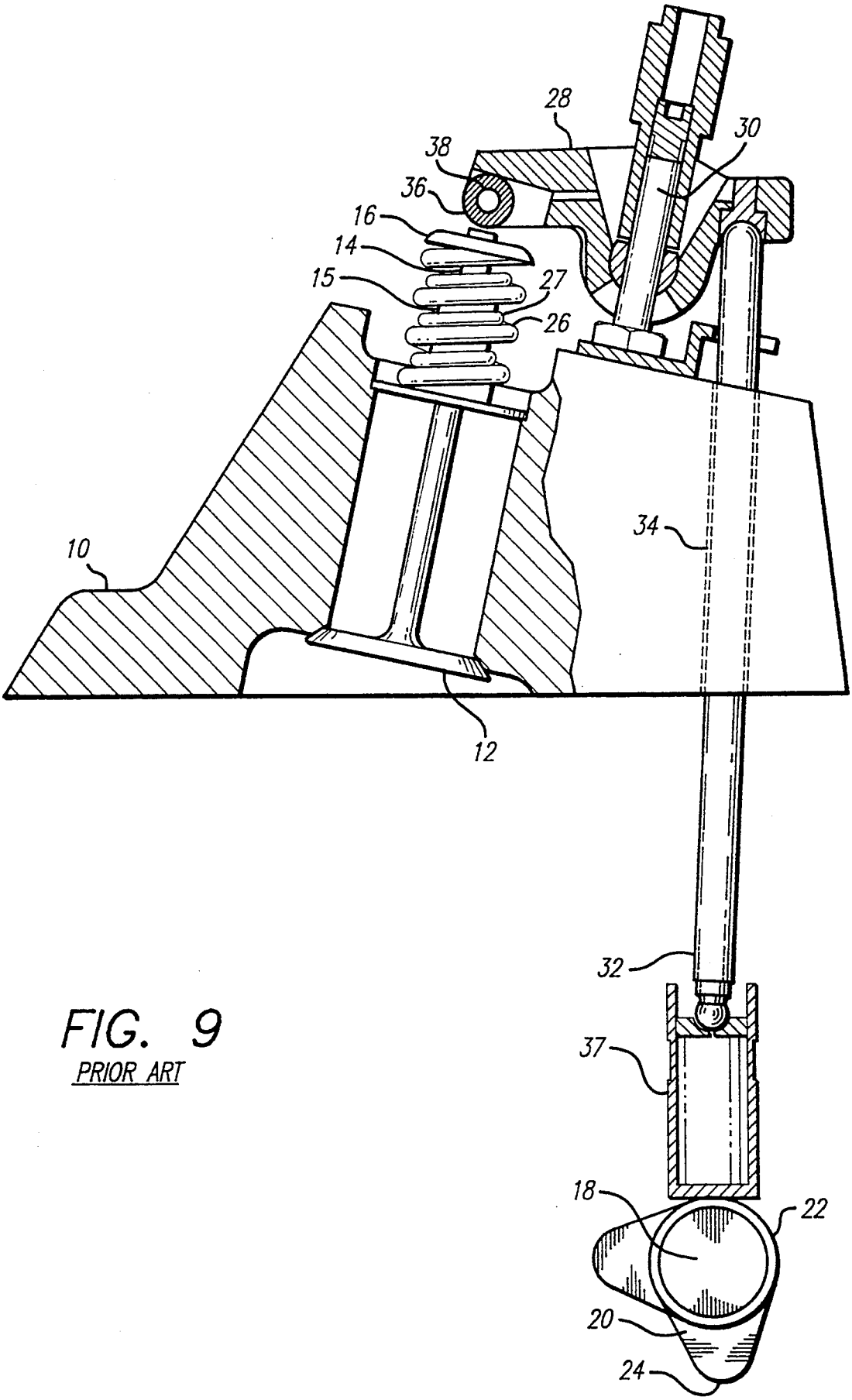
FIG. 9 PRIOR ART
FIG. 9 is a side elevational and partially sectional view of a conventional valve control device.

The valve spring 68 is a helical compression spring whose upper end abuts the retainer 56 attached to the stem 54 and whose lower end seats against the cylinder head 50. Like the conventional valve springs 26 and 27 shown in FIG. 9, the valve spring 68 functions to retain the valve 52 projected in its normal closed position. However, as will be more fully appreciated below, unlike the valve spring 26, the valve spring 68 is preferably a substantially weaker spring and cooperates with a push rod spring 71 (See, FIG. 1) of predetermined stiffness or elasticity to urge the valve engagement assembly 70 back to its neutral position. The desired strength of the valve spring 68, and consequently the degree to which it is weaker than the valve spring 26 of FIG. 9, is a function of the seat pressure acting on the valve and the stiffness or elasticity characteristics of the cooperative push rod spring 71. Nevertheless, the valve spring 68 is preferably, but not necessarily, of a predetermined stiffness or elasticity which corresponds to an adjusted reduction in seat pressure acting on the valve of advantageously, but not necessarily, 20–33% less than would be the case if the valve springs of FIG. 9 were used. It will be appreciated that the strength of a spring is a function of its predetermined stiffness or elasticity characteristics and its consequent resistance to displacement.

Figure 4:
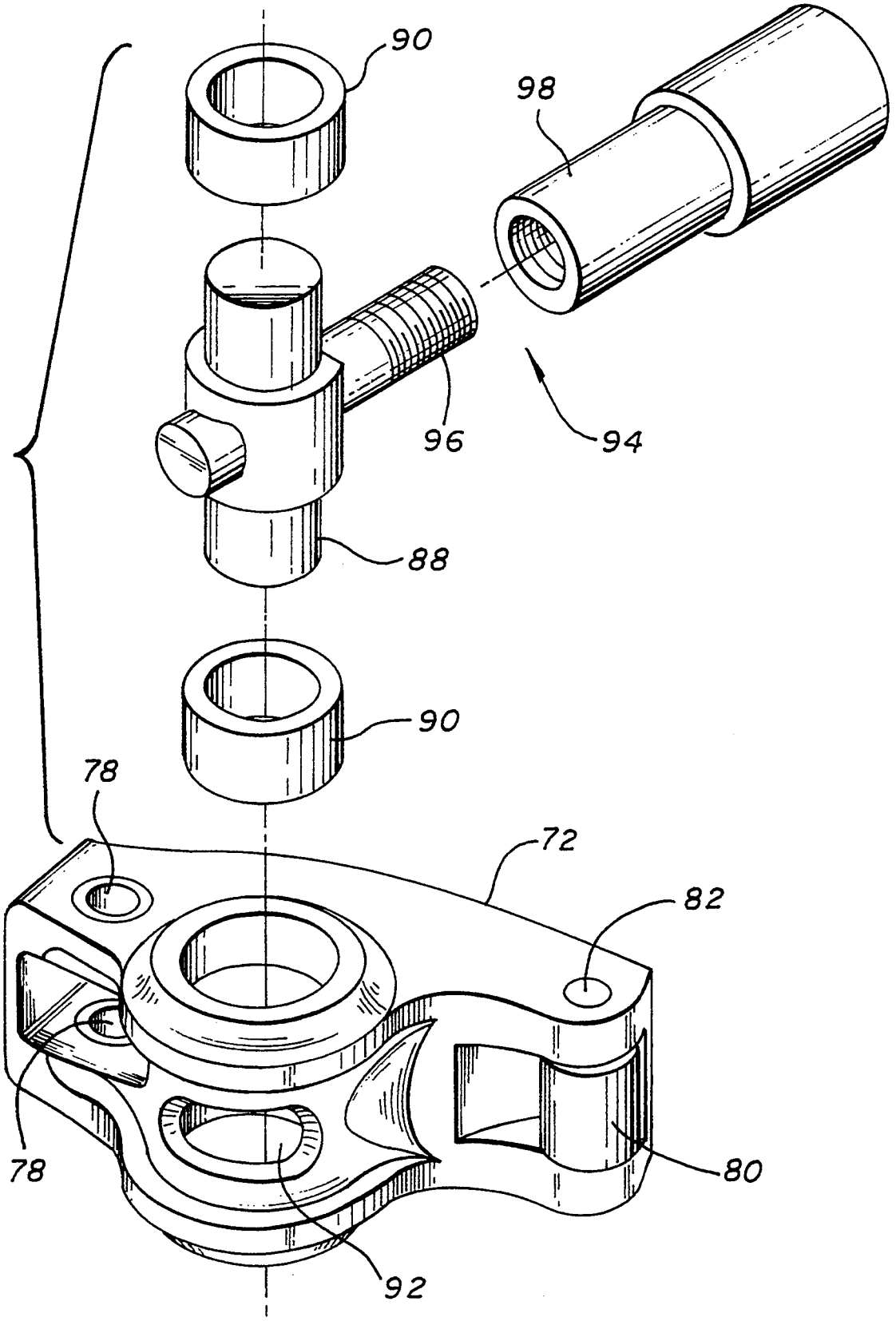
FIG. 4 is an enlarged and exploded perspective view of the rocker arm and its associated rocker shaft shown in FIG. 1.

The valve engagement assembly 70 includes a rocker arm 72 which is pivotally connected to the upper end of a push rod assembly 74 through a shaft 76 which is secured within two axially aligned bores 78 extending axially through the right end of the rocker arm. (See, FIGS. 1 and 4). As depicted in FIG. 4, the rocker arm is substantially hollow and includes a contact roller 80 which is rotatably connected to a rocker pin 82 extending axially through two axially aligned bores defined in the end of the rocker arm adjacent to the valve stem. The rocker arm 72 is also pivotally connected at its central portion to a rocker shaft 88 having two annular bearings 90 which is received within two axially aligned bores 92 defined in the central portion of the rocker arm. The rocker shaft itself is secured to a cylinder head shaft 94 that protrudes from the cylinder head 50 and includes an inner shaft section 96 which threadedly mates with an outer shaft section 98. For the purpose of permitting pivotal movement of the rocker arm, the central inner surface of the rocker arm which is located adjacent to the rocker shaft 88 is configured in a well understood manner. (See, FIGS. 1, 4).

The rocker arm 72 performs the same function as the conventional rocker arm 28 depicted in FIG. 9 and is shown in its neutral position in FIG. 1. However, the rocker arm 72 tends to be more durable than the conventional rocker arm 28. This is a consequence of the decreased stress exerted on the rocker arm 72 due to combination of the utilization of a substantially weaker valve spring 68 and the combined push-pull action of the valve spring 68 and push rod spring 71. It will be appreciated that the predetermined strength and mass of the rocker arm 72 is a function of the combination of the strength of the valve and push rod springs 68 and 71, the operational demands placed on the valve control device, and the operational characteristics of the engine.

Figure 3:
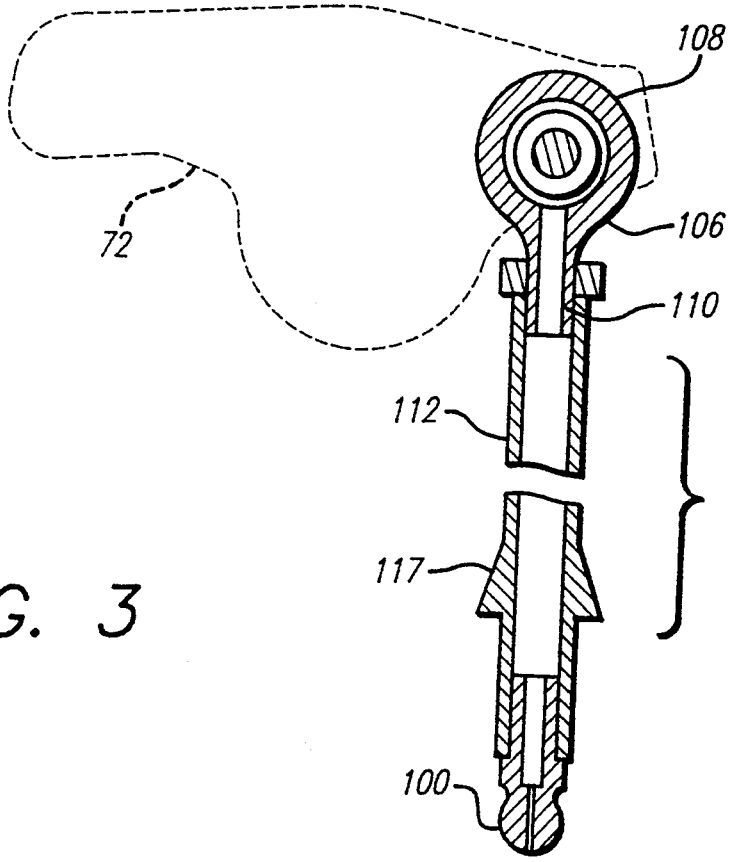
FIG. 3 is a partially fragmented, sectional side view of the push rod assembly shown in FIG. 1.

The push rod assembly 74 includes a push rod 100, which extends longitudinally through a thoroughbore 102 defined in the cylinder head 50, and push rod spring 71 situated around the lower portion of the push rod 100. (See, FIGS. 1, 3 and 5) The upper end of the push rod assembly 74, has a connecting piece 106 having a loop shaped head 108 and a threaded stem 110 for engaging a threaded bore 112 defined within the inner surface of the push rod 100. (See, FIG. 3). The loop shaped head 108 is itself pivotally connected to the shaft, thereby attaching the push rod assembly 74 to the rocker arm 72. The existence of the connecting piece 106 permits the length of the push rod 100 to effectively be adjusted by rotating the push rod relative to the connecting piece.

Figure 11:
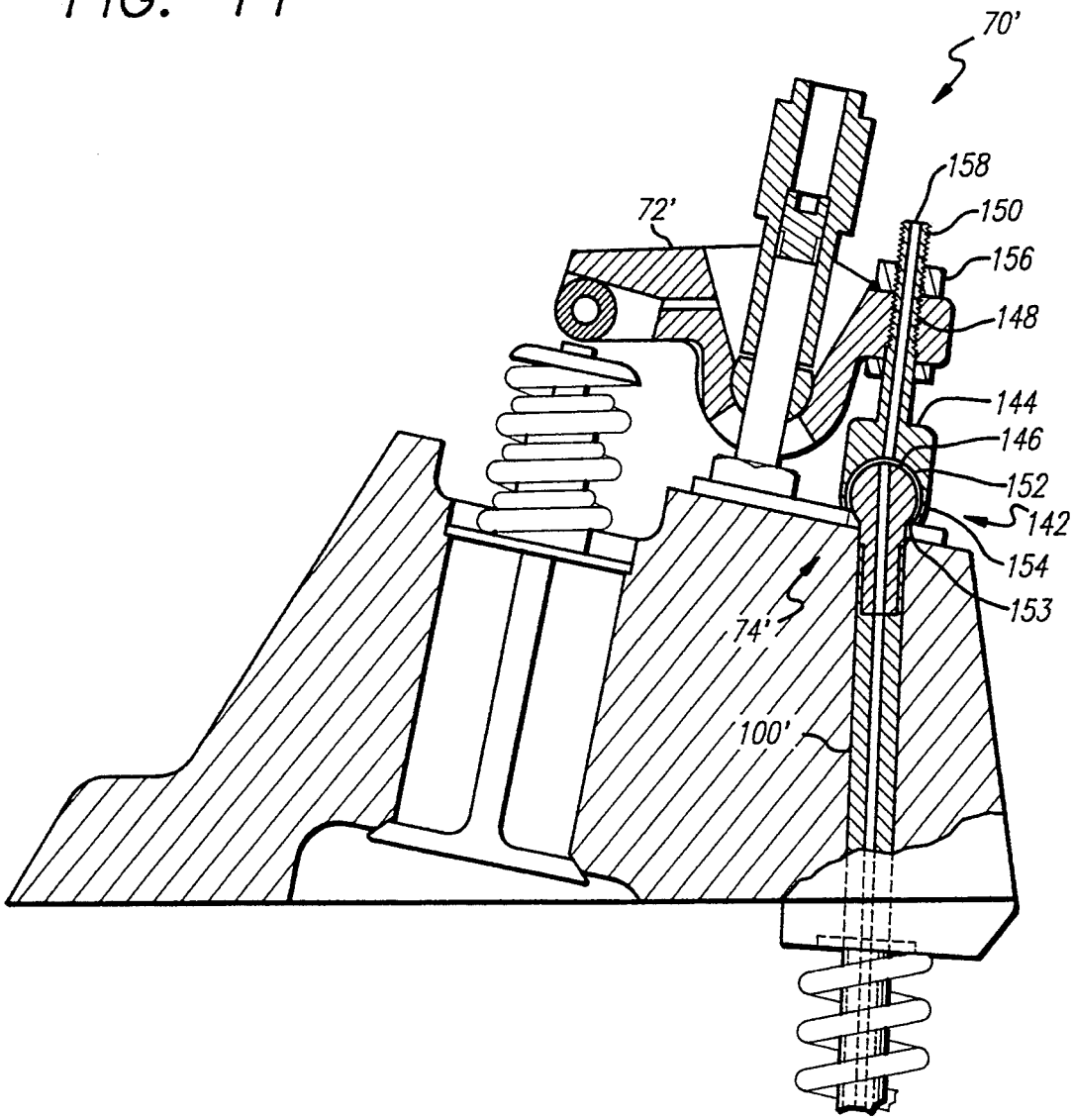
FIG. 11 is a side elevational and partially sectional view of an alternative embodiment of the valve control device of the present invention shown associated with a cylinder head of an engine.
Figure 12:
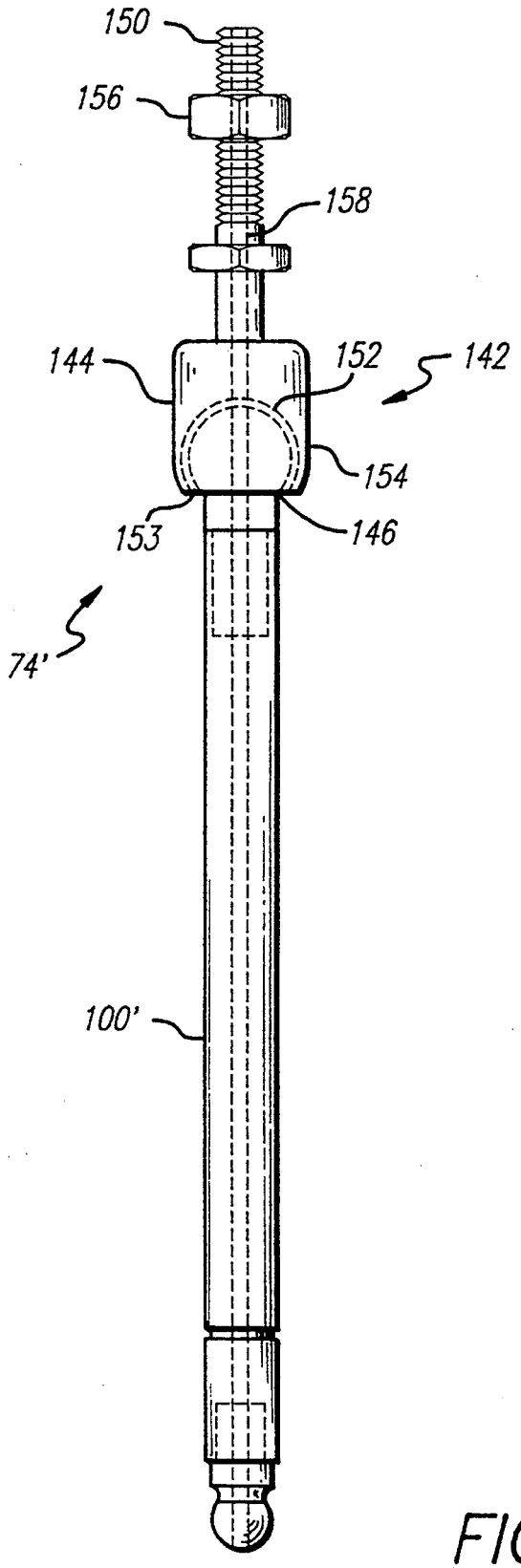
FIG. 12 is a side elevational view of the push rod assembly shown in FIG. 11.

In accordance with another embodiment, the rocker arm 72' is connected to a push rod assembly 74' which includes a ball and socket joint 142. (See FIGS. 11–12). The ball and socket joint 142 allows the push rod assembly not only to push, but also to pull on the rocker arm.

The push rod assembly 74' includes a push rod 100' and a threaded adjustment rod 144. The spherical ball portion 146 of the ball and socket joint 142 is formed at the upper end of the push rod. The rocker arm has a threaded hole 148 at one end of the rocker arm into which is screwed the threaded portion 150 of the adjustment rod. At the other end of the adjustment rod is a spherical socket 152 that receives the ball 146. The socket includes an opening 153 through which the push rod extends away from the ball portion of the ball and socket joint. The opening's diameter is smaller than the ball's diameter so that the ball is retained within the socket and is not removable from the socket during normal operating conditions. Yet, the opening is large enough to accommodate the rotational movement of the push rod within the socket which occurs when the push rod actuates the rocker arm. In the manufacture of the ball and socket joint, the wall 154 of the socket is advantageously crimped or otherwise formed over the ball to effectively permanently capture and retain the ball within the socket. Accordingly, since the ball is retained within the socket, any downward force on the push rod is transmitted through the ball and socket joint to the rocker arm. A hole 158 through the center of the adjustment rod allows lubricants to flow through the adjustment rod to lubricate the ball and socket joint.

The ball and socket joint also allows the push rod 100' to spin about its axis within the socket thereby tending to releasing stresses on the push rod assembly 74'. In addition, the push rod assembly uses less parts and is lighter in weight than the push rod assembly 74 described above, thereby tending to allow the valve engagement assembly 70' to last longer and the engine to produce more horsepower.

The valve clearance is adjusted by screwing the adjustment rod 144 in and out of the threaded hole 148 in the rocker arm 72'. Precision positioning of the adjustment rod is accomplished by means of a hex socket or screwdriver slot (not shown) at the end of the adjustment rod's threaded portion 150. When the adjustment rod is positioned to provide the proper valve clearance, an adjustment nut 156 on the adjustment rod's threaded portion is tightened against the rocker arm to lock the adjustment rod in the proper position. The adjustment nut is preferably located at the top of the rocker arm allowing for easy adjustment of the valve clearance.

The push rod assembly 74' also advantageously tends to improve the performance of engines using conventional valve control devices of the type shown in FIG. 9. If the engine operates at sufficiently high rotational speed ("RPM"), the cam lobe 20 may fall faster than the valve 12 can close. Since the rocker arm 28 is not connected to the push rod, a gap may form between the rocker arm and the push rod and/or the valve stem 14. As will be appreciated, this gap allows the rocker arm to "float" between the end of the push rod and the end of the valve stem. Eventually, the valve returns to the closed position, thereby eliminating the gap and causing the valve stem to impact against the rocker arm which in turn may impact against the push rod. Such impacts tend to cause harmonics in the various components of the valve control device. Eventually, the valve control device may develop problems, such as rocker arm breakage, push rod breakage, valve lifter breakage, valve stem mushrooming and fuel contamination. Thus, by replacing the conventional push rod 32 with a push rod 100' which is connected to the rocker arm 72', the above-mentioned problems tend to be avoided.

As is conventional (See, FIG. 1), a valve lifter 114 can be interposed between the cam lobe 62 and the bottom of the push rod 100 to facilitate transmission of the action of the cam lobe 62 to the push rod. To this end, the bottom of the push rod defines a smooth convex surface for maintaining appropriate contact with the valve lifter 114. Thus, when the valve control device is in its neutral position with the valve 52 closed, the valve lifter is held in close proximity or slight contact with the cam lobe 62. On the other hand, when the cam lobe 62 urges the valve lifter upward, the valve lifter actuates the push rod 100 longitudinally upward. The push rod can also be adjusted as described above to maintain the appropriate interface between the valve lifter and the push rod.

For the purpose of appropriately retaining the push rod spring 71, the push rod assembly 74 further includes a spring stop 116. The stop is detachably secured to the push rod 100 by virtue of its bearing against a section 117 of the lower end of the push rod which is flared radially outward. The stop includes a drum-shaped upper section 118 which is integral with an annular or disc shaped lower section 120. (See, FIGS. 1 and 5). Thus, it will be observed that the lower end of the push rod spring 71 abuts against the disc shaped section 120 of the stop 116, thereby preventing the push rod spring from sliding downward.

Figure 2:
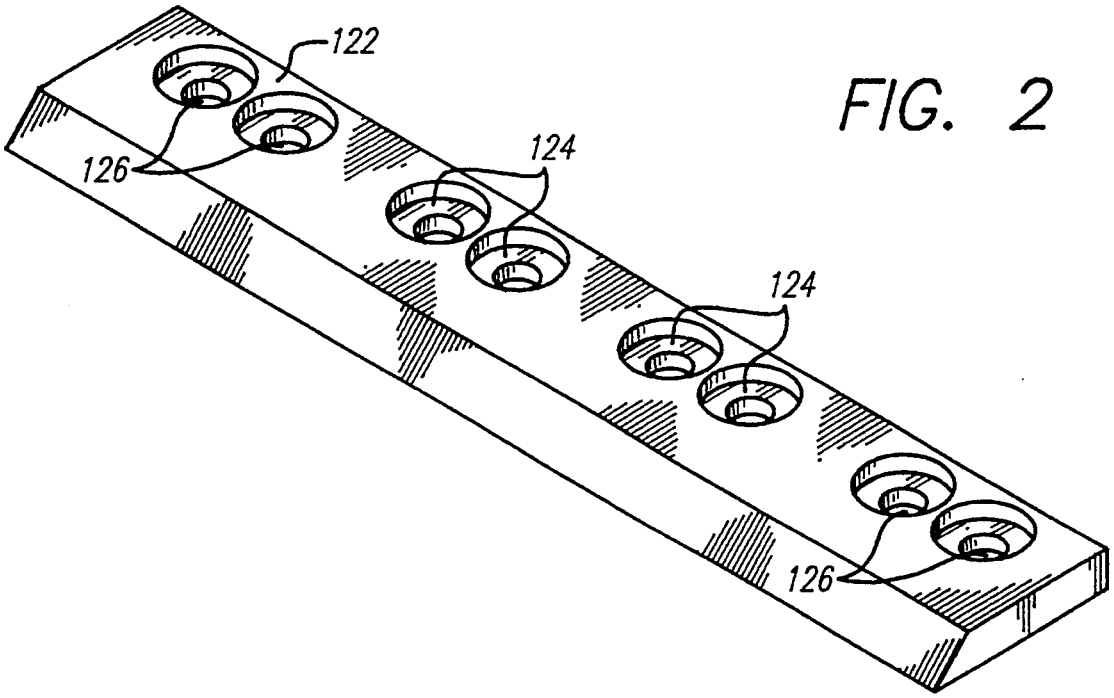
FIG. 2 is an enlarged perspective view of the seating plate shown in FIG. 1 which is associated with the valve engagement assembly of the present invention.

In order to facilitate proper compression of the push rod spring 71, the push rod assembly 74 also includes a seating plate 122 which is attached to the cylinder head 50. (See, FIG. 2) The seating plate defines a series of separate circular indentations 124 formed in the surface of the plate that faces the push rod spring 71. (See, FIG. 2). Each indentation defines an inner surface which is appropriately contoured such that the upper portion of the push rod spring 71 can be received and anchored within the indentation. Such indentation, therefore, acts as a stop which limits the upward movement of the push rod spring. A suitable washer or shim (not shown) can also be snugly situated within each such inner surface of the indentation 124 in order to encourage proper compression of the push rod spring as it is biased against the circular indentation.

Each circular indentation 124 further defines a suitably dimensioned central bore 126 through which the push rod 100 passes. To this end, the seating plate 122 is attached to the cylinder head 50 such that a given thoroughbore 102 in the cylinder head is aligned with the bore 126 in the indentation 124. Thus, the push rod 100 extends successively through the bores 102 and 126, as well as through the push rod spring 71 which is anchored in a particular indentation 124. It will be understood that seating plates having a series of indentations and central bores are utilized for engines having a plurality of valves and associated valve control devices (See, FIG. 2).

The push rod spring 71 is of the helical compression type. It further has preselected stiffness or elasticity characteristics sufficient to repeatedly return the valve engagement assembly 70 to its neutral position by operating in cooperation with the valve spring 68. To this end, the push rod spring 71 is preferably weaker than the valve spring 68 and its desired strength can be determined based on the seat pressure acting on the valve 52 and the preselected stiffness or elasticity characteristics of the valve spring 68 in a well understood manner. Nevertheless, it is advantageously of strength which in itself is sufficient enough to pull back the push rod 100 and rocker arm 72 to their neutral positions without the assistance of biasing force from the valve spring 68. Moreover, the strength of the valve spring 68 relative to the strength of the push rod spring 71 is determined in accordance with a number of well appreciated parameters, including the weight and dynamics of the valve and the performance requirements of the engine. Therefore, in accordance with these parameters various combinations of spring strength can be preselected, including combinations in which the push rod spring 71 is stronger than the valve spring 68 or equal in strength to the valve spring 68.

The operation of the valve control device of the present invention will now be discussed. As the cam lobe 62 rotates, the arcuate apex 66 of the cam lobe serves to lift the push rod 100 longitudinally upward from its neutral position and thereby compress the push rod spring 71 against the indentation 124 within the seating plate 122. The upward movement of the push rod causes the rocker arm 72 to pivot downward or counterclockwise and into engagement with the top of the stem 54. Consequently, the contact roller 80 of the rocker arm 72 actuates the valve 52 which compresses the valve spring 68 as the valve 52 is opened. As the cam lobe continues to rotate, the push rod 100 becomes aligned with the neutral surface 64 of the cam lobe and the valve spring 68 and push rod spring 71 substantially simultaneously expand so as to give rise to combined push-pull forces with the valve spring pushing upward on the rocker arm and the push rod spring pulling downward on the push rod. The combined biasing forces of the springs 68 and 71 thus return the valve control device to its original or neutral position with the expanding push rod spring 71 forcing the push rod 100 downward and the expanding valve spring 68 pivoting the rocker arm 72 upward or clockwise.

The feature of the valve spring 68 and push rod spring 71 of the present invention acting substantially in unison and in a push-pull relationship combine to return the valve engagement assembly 70 to its neutral position. This feature thus gives rise to enhanced engine performance characteristics, as well as to enhanced useful life for the valve engagement assembly 70 due to the reduction in the formerly more isolated stress exerted on the rocker arm 72 by the valve spring 68. This feature further tends to permit use of less seat pressure such that the useful life of the valve 52 is extended, and the engine and oil operating temperature tends to be reduced, and full economy tends to be improved and pollutant output diminished. It will also be understood that, since the overall energy required to move the valve engagement assembly is reduced, the cam lobe 62 of the cam shaft 60 and the timing chain engaging the cam shaft gear can be made lighter. Therefore, the gears associated with the crankshaft can be made lighter. This permits more available horsepower to be transmitted to the drive train.

Moreover, it will be appreciated that, when the valve engagement assembly 70 engages the valve spring 68, the push rod 100 is typically displaced less distance than the distance the valve spring 68 is compressed. Thus, since the push rod spring 71 is connected to the push rod, it is similarly displaced less distance than would otherwise be the case if it were connected to the stem 54 of the valve 52 along with the valve spring 68. Therefore, there tends to be a substantial reduction in the overall force otherwise used to return the valve engagement assembly 70 to its neutral position. It will also be understood that the above described movement of the valve control device occurs rapidly and repeatedly as the push rod 100 reciprocates.

Some of the features and advantages of the present invention can better be appreciated by comparative reference to test results involving the valve control device of the present invention and the conventional valve control device shown in FIG. 9. More specifically, output torque and power performance characteristics of a basic Chevrolet 350 cu. in. engine ("street engine") and a Chevrolet 350 cu. in. racing engine ("racing engine") were evaluated as functions of rotational speed ("RPM") in the case of both the valve control device of FIG. 1 and the conventional valve control device of FIG. 9. Prior to the test runs with each of the valve control devices, the particular engine was fully tuned and then monitored on a dynamometer to ensure that the engine was operating as optimally as possible.

Figure 7A:
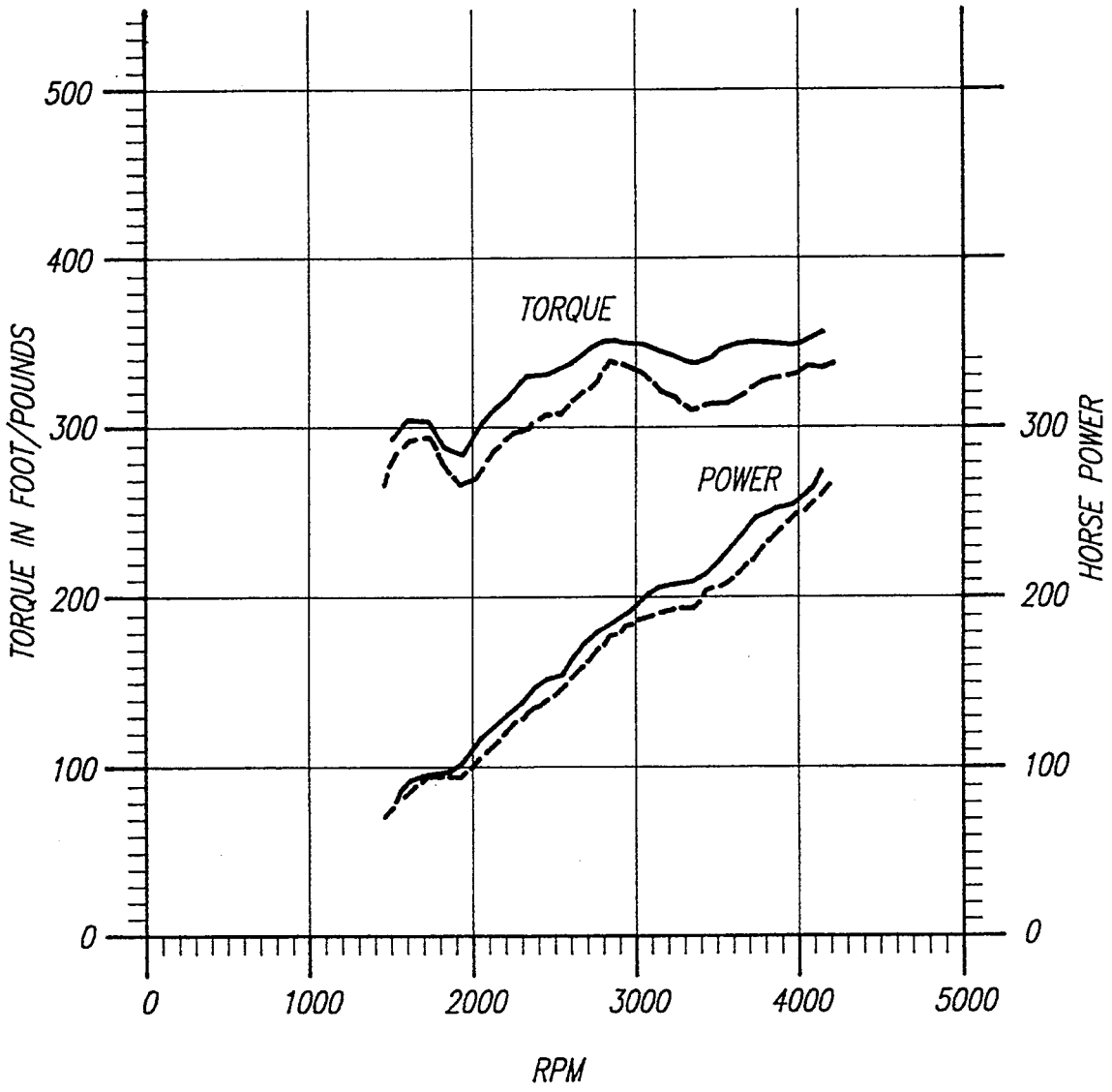
FIGS. 7A and 7B are graphs with solid lines depicting improved engine power and torque values associated with the present invention and with dotted lines depicting power and torque values associated with the conventional valve control device of FIG. 9.
Figure 7B:
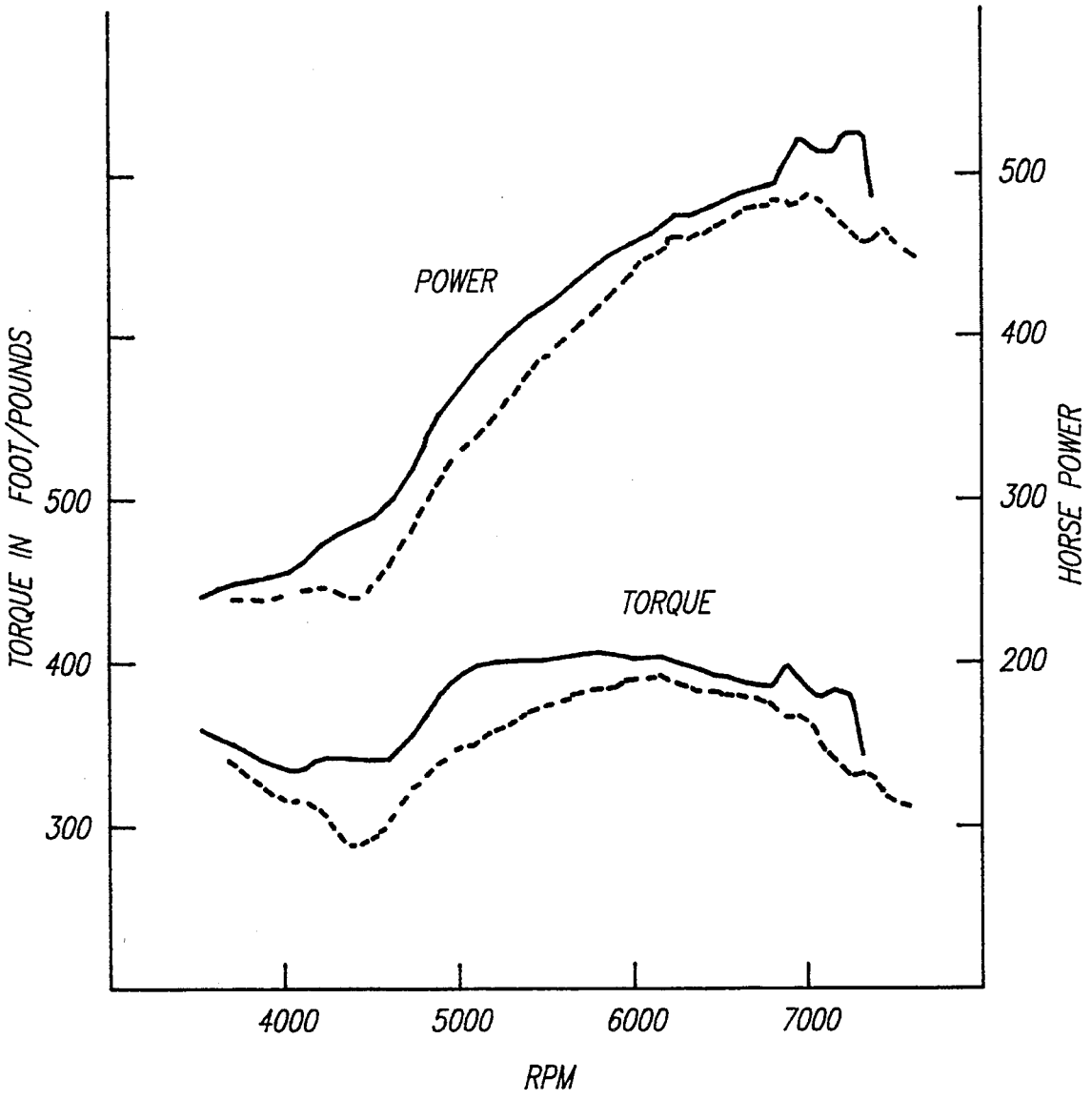

FIGS. 7A and 7B contain graphs depicting the results of these tests for a street engine and a racing engine respectively. The broken lines in each figure show the power and torque curves corresponding to use of the conventional valve control device, while the solid lines show the power and torque curves corresponding to use of the push-pull valve control device of the present invention. It will be observed from FIGS. 7A and 7B that the present push-pull valve control device results in improving output torque between 3% and 10% and power by about 10%. Further, the torque curve becomes flatter over a wider range of rotational speed, thereby providing for a smoother running engine. More of the power of the engine is, therefore, available for use than would otherwise be the case. Moreover, no damage to the rocker arm 72 was observed, despite many hours of high RPM operation.

The aforementioned tests also reflected that fuel economy tended to be substantially improved via utilization of the present valve control device. By way of example, certain comparative test runs were performed under actual racing conditions with two racing automobiles, one of which utilized a 350 cu. in. racing engine with the valve control device of FIG. 1 and the other of which used a similar 350 cu. in. engine with conventional valve control device of FIG. 9. While each automobile travelled the same distance, the automobile employing the valve control device of FIG. 1 consumed approximately $\frac{1}{3}$ less fuel in these tests. A factor contributing to this increased fuel economy resides in the fact that the use of the present invention advantageously allowed for smaller jets to be employed for the carburetor that was associated with the racing engine having the present invention. It will be understood that the smaller jets provided a less rich fuel/air mixture with consequent fuel savings. Further, vehicle emissions tests showed a substantial reduction in certain pollutants, such as hydrocarbons, carbon monoxide and carbon dioxide when a 350 cu. in. engine having the invention was employed.

Figure 8A:
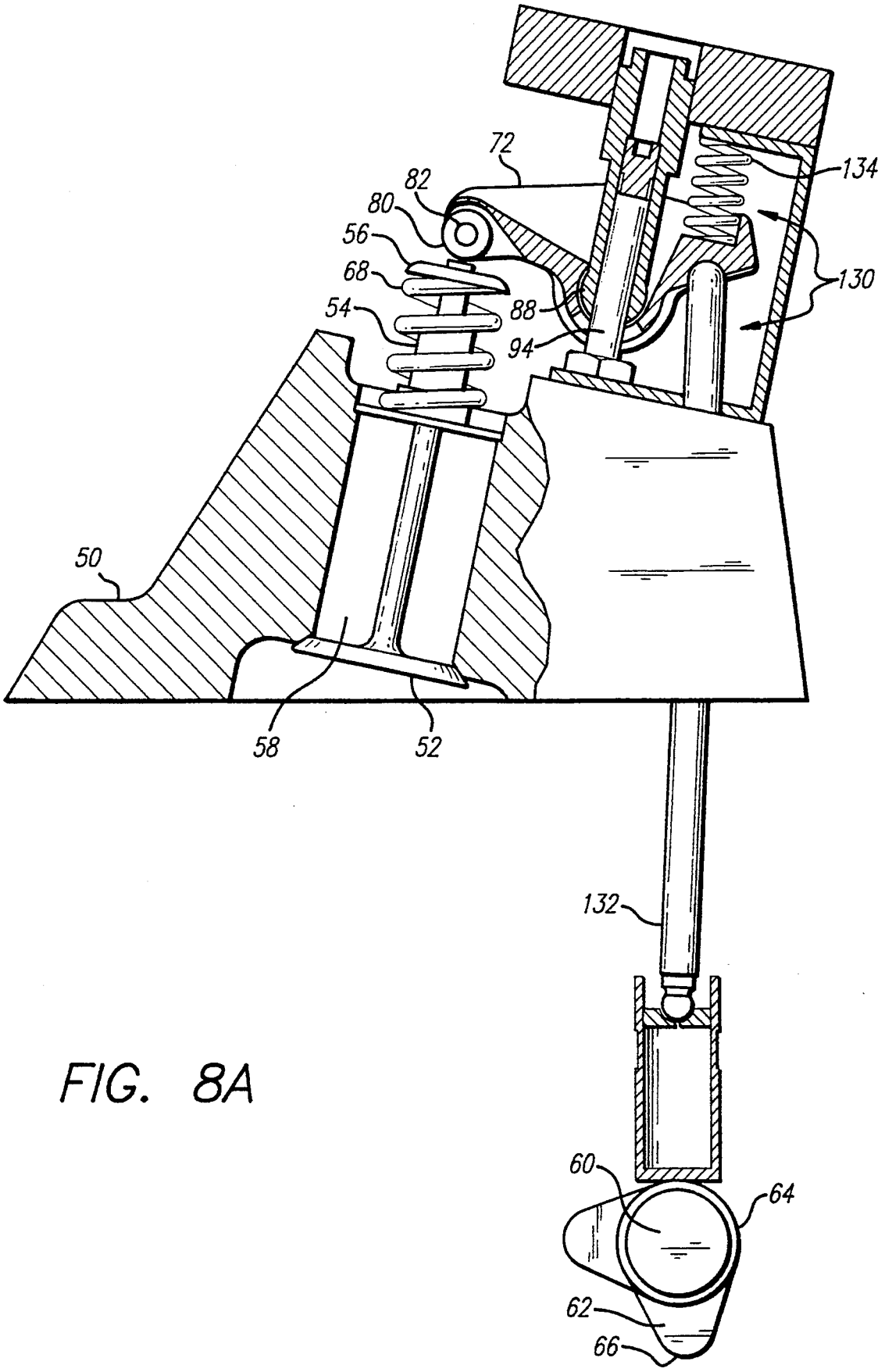
FIG. 8A and FIG. 8B are side elevational views of an alternative embodiment of the present invention.
Figure 8B:
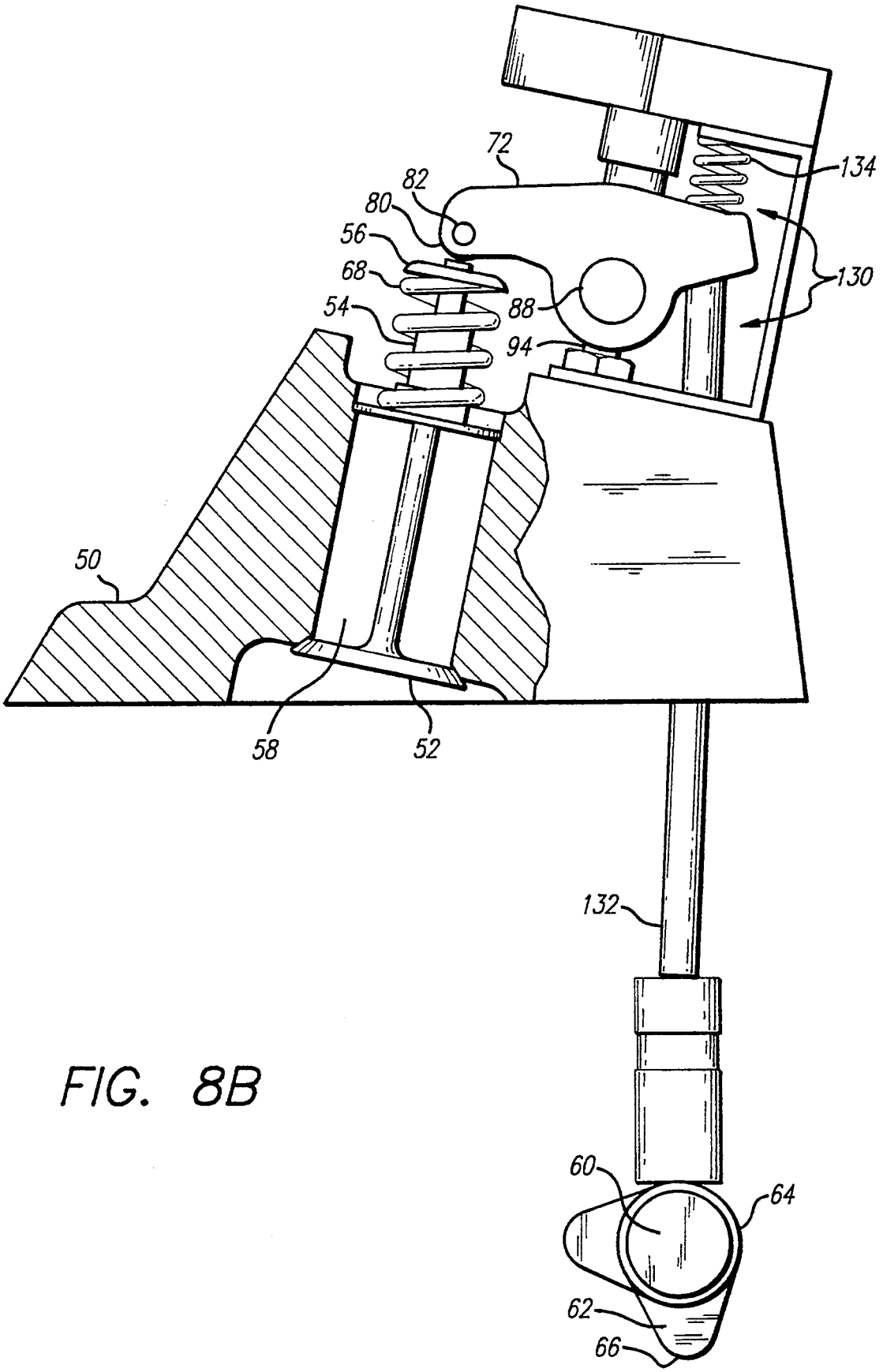

An alternative embodiment of a valve control device of the present invention is shown in FIGS. 8A and 8B. It has the same valve spring 68, and a similar valve engagement assembly except for a push rod assembly 130. In particular, the push rod assembly 130 of FIGS. 8A and 8B includes a push rod 132 which is engageable with the rocker arm 72. A push rod spring 134, which is of the helical compression type, is attached to the engine and is engageable with the rocker arm 72. The overall operation of the alternative embodiment of FIGS. 8A and 8B is substantially similar to that of the embodiment of FIG. 1. Thus, the valve spring 68 and push rod spring 134 combine to return the valve engagement assembly to its neutral position.

Figure 10:
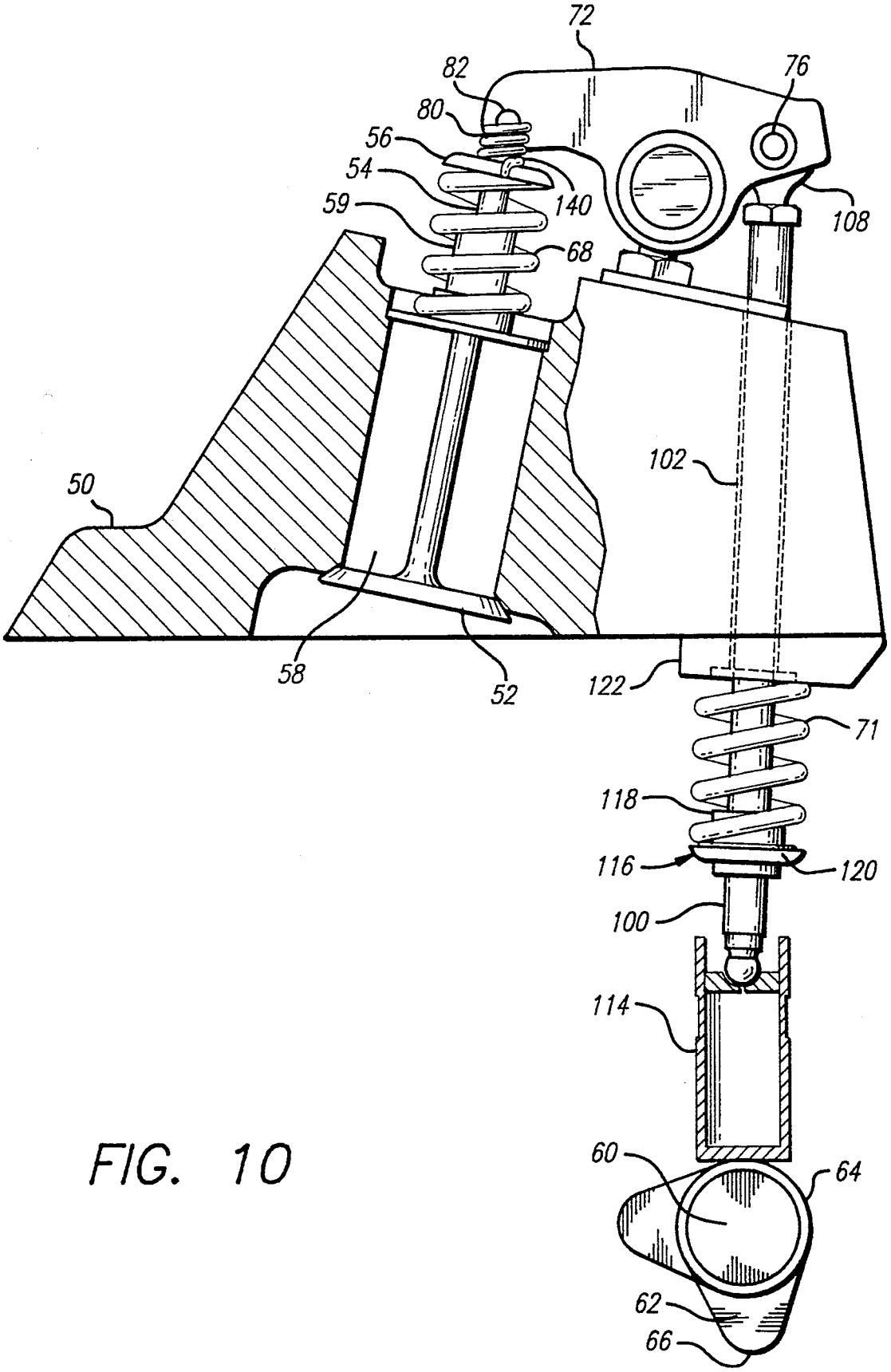
FIG. 10 is a side elevational view of another alternative embodiment of the present invention.

Still another alternative embodiment of a valve control device of the present invention is shown in FIG. 10. It has the same valve spring 68, and a similar valve engagement assembly, except for the addition of a pull spring 140 of predetermined stiffness or elasticity. The spring 140 is connected to the rocker arm 72 and the retainer 56 and facilitates movement of the valve spring 68 back to its neutral position after the valve has opened. The spring 140 can also be utilized in connection with embodiment of FIGS. 8A–8B.

It will thus be appreciated that the present invention provides a valve control device of augmented durability and related method of valve control which enhance performance characteristics of an internal combustion engine and are conducive to improved fuel economy and diminished output of certain pollutants. Moreover, the engine tends to run cooler, thereby reducing wear and tear on the engine and diminishing output of pollutants. Such a valve control device can be made available to the user in the form of a kit or in the form of individual components which are specifically adapted for valve control in accordance with the present invention. It can further be installed in existing engines with only relatively minor modifications.

Although the invention has been described in detail with reference to the presently preferred embodiments, it will be appreciated by those skilled in the art that various modifications can be made without departing from the spirit and scope of the invention. Accordingly, the invention is limited only by the following claims.

I claim:

1. A ball and socket assembly for interconnecting a rocker arm and a push rod of a valve control device that controls an engine valve, comprising:

a ball connected to at least one of the push rod or rocker arm; and a socket of predetermined internal configuration which captures the ball such that the push rod is interconnected to the rocker arm and is rotatable and thereby is adapted to push and pull on the rocker arm, the socket further being connected to at least one of the push rod or the rocker arm.

2. A ball and socket assembly according to claim 1, wherein the ball is substantially spherical.

3. A ball and socket assembly according to claim 1, wherein the internal configuration of the socket is substantially spherical.

4. A ball and socket assembly according to claim 1, wherein:

the ball is connected to the push rod; and the socket is connected to the rocker arm.

5. A ball and socket assembly according to claim 4, wherein the socket is defined in an adjustment rod that is attached to the rocker arm.

6. A ball and socket assembly for interconnecting a rocker arm and a push rod of a valve control device that controls an engine valve, comprising:

a substantially spherical ball connected to the push rod; and a socket of predetermined internal configuration associated with the push rod, the socket further capturing the ball such that the push rod is rotatable and is interconnected to the rocker arm and thereby is adapted to push and pull on the rocker arm.

7. A ball and socket assembly according to claim 6, wherein the assembly further includes an adjustment rod which is secured to the rocker arm and defines the socket.

8. A valve control device for controlling an engine valve in response to movement of a camshaft associated with the engine, the valve being contained within a cylinder head of the engine and being movable between open and closed positions, comprising:

(a) first valve closure means, associated with the valve for resiliently resisting movement of the valve in response to movement of the camshaft;

(b) a rocker arm pivotally connected to the engine and engageable with the valve;

(c) a push rod; and (d) a ball and socket assembly, including (1) a ball connected to the push rod, and (2) a socket of predetermined internal configuration, associated with the rocker arm, for capturing the ball such that the push rod is interconnected to the rocker arm and is thereby rotatable and adapted to push and pull on the rocker arm, the push rod further being reciprocable in response to movement of the camshaft and movable downward in response to actuation by the first valve closure means.

9. A valve control device according to claim 8, wherein the ball and internal configuration of the socket are substantially spherical.

10. A valve control device according to claim 8, wherein the socket is defined in an adjustment rod that is attached to the rocker arm.

* * * * *